US009856776B1

(12) United States Patent
Tan et al.

(10) Patent No.: US 9,856,776 B1
(45) Date of Patent: Jan. 2, 2018

(54) MUFFLER WITH DOUBLE SHELL HOUSING

(71) Applicant: Caterpillar Inc., Peoria, IL (US)

(72) Inventors: Dongming Tan, Dunlap, IL (US); Faiz Khan, Dunlap, IL (US); Sairam Thiagarajan, Dunlap, IL (US); Zubair Mohammed, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/266,807

(22) Filed: Sep. 15, 2016

(51) Int. Cl.

| | |
|---|---|
| ***F01N 13/14*** | (2010.01) |
| ***F01N 13/18*** | (2010.01) |
| ***G10K 11/16*** | (2006.01) |
| ***F01N 1/02*** | (2006.01) |

(52) U.S. Cl.
CPC ..... *F01N 13/141* (2013.01); *F01N 1/02* (2013.01); *F01N 13/1838* (2013.01); *G10K 11/161* (2013.01)

(58) Field of Classification Search
CPC ..... F01N 13/141; F01N 13/1838
USPC ..... 181/249, 255, 269, 282
See application file for complete search history.

(56) References Cited

U.S. PATENT DOCUMENTS

| | | | | |
|---|---|---|---|---|
| 4,073,361 | A | 2/1978 | Murota et al. | |
| 4,094,644 | A | 6/1978 | Wagner | |
| 5,340,952 | A | 8/1994 | Takiguchi | |
| 6,619,426 | B2 | 9/2003 | Minami et al. | |
| 7,155,902 | B2 * | 1/2007 | Nakagome | F01N 3/2842 138/114 |
| 7,464,789 | B2 | 12/2008 | Yamamoto et al. | |
| 8,397,863 | B2 | 3/2013 | Paze' | |
| 2009/0313982 | A1 * | 12/2009 | Nishizawa | F01N 1/085 60/322 |
| 2012/0273301 | A1 | 11/2012 | Jones et al. | |
| 2016/0221658 | A1 * | 8/2016 | Achiwa | B63H 20/245 |

FOREIGN PATENT DOCUMENTS

| | | | |
|---|---|---|---|
| EP | 0831211 | A | 3/1998 |

* cited by examiner

*Primary Examiner* — Jeremy Luks
(74) *Attorney, Agent, or Firm* — Miller, Matthias & Hull

(57) ABSTRACT

A muffler is disclosed. The muffler may comprise an expansion chamber and a double shell housing surrounding the expansion chamber and extending from a first end to a second end. The double shell housing may include an annular perforated inner shell, an annular outer shell surrounding the inner shell, and an insulation between the inner shell and the outer shell. The muffler may further comprise at least one C-bracket between the inner shell and the outer shell at each of the first and second ends of the double shell housing. Each of the C-brackets may include a first leg, a second leg, and a linking portion connecting the first leg and the second leg. The second leg may be in abutting engagement with the outer shell.

20 Claims, 5 Drawing Sheets

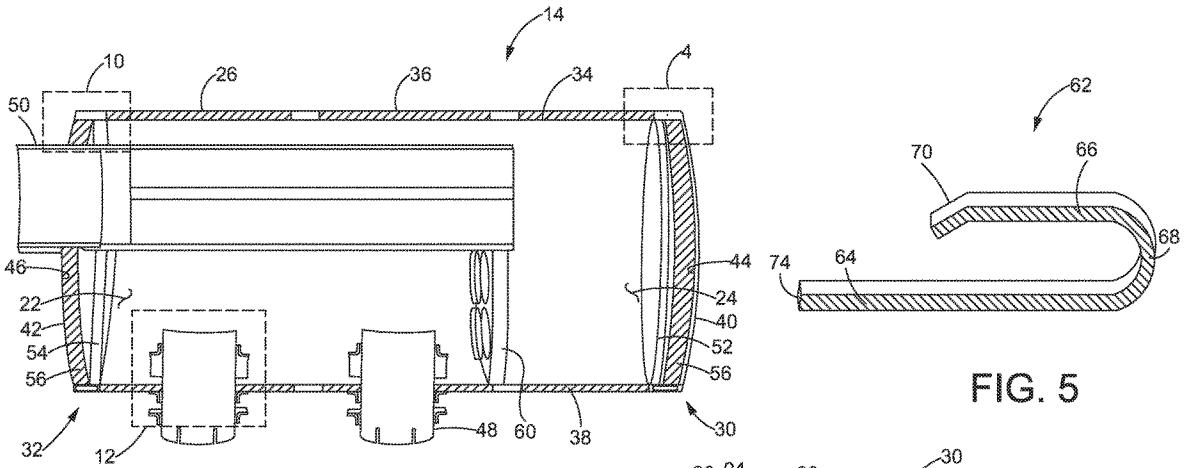
FIG. 3
FIG. 5
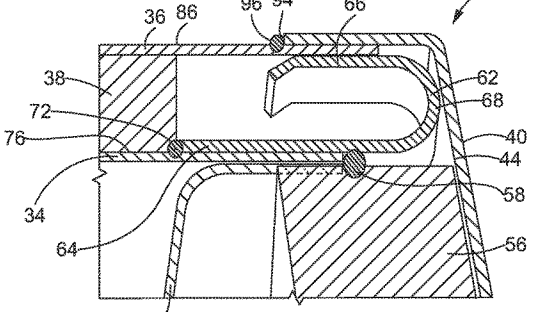
FIG. 4

MUFFLER WITH DOUBLE SHELL HOUSING

TECHNICAL FIELD

The present disclosure generally relates to mufflers and, more specifically, relates to mufflers having reduced susceptibility to thermal stress.

BACKGROUND

Mufflers are installed in the exhaust system of internal combustion engines and act as acoustic soundproofing devices that reduce noise generated by the exhaust of the internal combustion engine. Mufflers may include an inlet pipe through which the exhaust gas enters the muffler, an internal expansion chamber where the exhaust gases expand to reduce noise, and an outlet pipe through which the exhaust exits the muffler for emission to atmosphere. Some muffler designs also include a double shell housing having an annular inner shell, an annular outer shell, and a layer of insulation interposed between the inner shell and the outer shell. Furthermore, in some muffler designs, the inner shell and the outer shell may be connected by inverted U-ring brackets that are welded to both the inner shell and the outer shell. The inverted U-ring brackets may each extend around a circumferential axis between the inner shell and the outer shell.

The layer of insulation between the inner and outer shells may lead to a large temperature difference between the shells as the inner shell is exposed to the high temperature exhaust gases within the expansion chamber. When exposed to the high temperature exhaust gases, the inner shell may expand (or contract) thermally, thereby subjecting the double shell housing to thermal stress that is concentrated at the welding sites between the inner and outer shells. With extended use, the thermal stress may cause cracking of the outer shell at the welding sites, leading to a shortened lifetime for the muffler. Moreover, other locations of the muffler may also be susceptible to thermal stress and weld cracking where the inner shell is constrained to another component with welded connections.

U.S. Pat. No. 4,094,644 discloses a muffler having an inner shell and an outer shell that are welded together. While effective, the welds between the inner and outer shells may be vulnerable to thermal stress when thermal gradients exist between the inner and outer shells. Thus, there is a need for improved double shell muffler designs that mitigate thermal stress at welding sites of the muffler caused by thermal expansion of the inner shell.

SUMMARY

In accordance with one aspect of the present disclosure, a muffler for exhaust from an internal combustion chamber is disclosed. The muffler may comprise an expansion chamber, and a double shell housing surrounding the expansion chamber and extending from a first end to a second end. The double shell housing may include an annular perforated inner shell, an annular outer shell surrounding the inner shell, and an insulation between the inner shell and the outer shell. The muffler may further comprise a first end cap at the first end of the double shell housing, and the first end cap may have an inner surface facing the expansion chamber. The muffler may further comprise a second end cap at the second end of the double shell housing, and the second end cap may have an inner surface facing the expansion chamber. The muffler may further comprise at least one C-bracket between the inner shell and the outer shell at each of the first and second ends of the double shell housing. Each of the C-brackets may include a first leg welded to the inner shell, a second leg in abutting engagement with the outer shell, and a linking portion connecting the first leg and the second leg. The linking portion of the C-bracket at the first end may be in abutting engagement with the inner surface of the first end cap. The linking portion of the C-bracket at the second end may be in abutting engagement with the inner surface of the second end cap.

In accordance with another aspect of the present disclosure, a muffler for exhaust from an internal combustion engine is disclosed. The muffler may comprise an expansion chamber, a double shell housing surrounding the expansion chamber and having a body portion extending axially between a first end and a second end. The body portion of the double shell housing may be formed from an annular perforated inner shell and an outer shell surrounding the inner shell. The muffler may further comprise an insulation between the inner shell and the outer shell, a first end cap at the first end of the double shell housing, and a second end cap at the second end of the double shell housing. The first end cap may have an inner surface facing the expansion chamber, and the second end cap may have an inner surface facing the expansion chamber. The muffler may further comprise a ring of C-brackets between the inner shell and the outer shell at each of the first and second ends of the double shell housing. Each of the rings of C-brackets may include a plurality of C-brackets distributed around a circumferential axis between the inner shell and the outer shell. Each of the C-brackets may include a first leg welded to the inner shell, a second leg in abutting engagement with the outer shell, and a linking portion connecting the first leg and the second leg. The linking portions of the C-brackets at the first end may be in abutting engagement with the inner surface of the first and cap, and the linking portions of the C-brackets at the second end may be in abutting engagement with the inner surface of the second end cap.

In accordance with another aspect of the present disclosure, a muffler for exhaust from an internal combustion engine is disclosed. The muffler may include a double shell housing extend from a first end to a second end that is formed from an annular perforated inner shell and an annular outer shell surrounding the inner shell. The muffler may further include a ring of C-brackets between the inner shell and the outer shell at each of the first and second ends of the double shell housing. Each of the C-brackets may include a first leg, a second leg, and a linking portion connecting the first leg and the second leg. The muffler may be fabricated by a method comprising forming the ring of C-brackets at each of the first and second ends by welding the first leg of each of the C-brackets to an outer surface of the inner shell, and placing at least one layer of insulation around the outer surface of the inner shell. The method may further comprise sliding the outer shell around the inner shell and the layer of insulation so that the second leg of each of the C-brackets is in abutting engagement with the outer shell. The method may further comprise welding a first end cap to the outer shell at the first end so that an inner surface of the first end cap is in abutting engagement with the linking portions of the C-brackets at the first end, and welding a second cap to the outer shell at the second end so that an inner surface of the second end cap is in abutting engagement with the linking portions of the C-brackets at the second end.

These and other aspects and features of the present disclosure will be more readily understood when read in conjunction with the accompanying drawings.

BRIEF DESCRIPTION OF THE DRAWINGS

FIG. 3 is a cross-sectional view through the section 3-3 of FIG. 2, illustrating a double shell housing of the muffler, constructed in accordance with the present disclosure.

FIG. 4 is an expanded view of detail 4 of FIG. 3, constructed in accordance with the present disclosure.

FIG. 5 is a cross-sectional view of a C-bracket of FIG. 4, constructed in accordance with the present disclosure.

DETAILED DESCRIPTION

Figure 1:
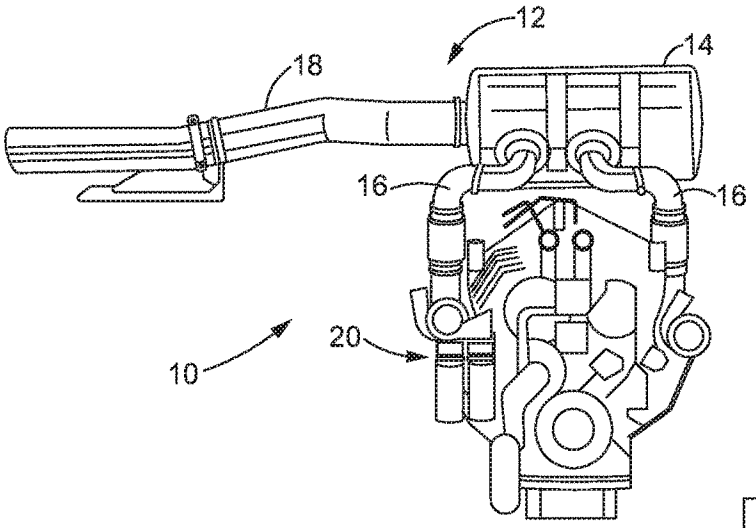
FIG. 1 is a perspective view of an internal combustion engine and a muffler in an exhaust line of the engine, constructed in accordance with the present disclosure.

Referring now to the drawings, and with specific reference to FIG. 1, an internal combustion engine 10 is shown. The engine 10 may include an exhaust line 12 for carrying exhaust produced by combustion in the engine 10, a muffler 14 in the exhaust line 12 for reducing noise emitted by the exhaust. The engine 10 may combust one or more types of fuel to provide mechanical energy to various types of machines such as, but not limited to, off-highway vehicles, mining trucks, earth-moving equipment, as well as other types of machines and equipment. The exhaust line 12 may include one or more exhaust inlet pipes 16 leading to the muffler 14, and one or more exhaust outlet pipes 18 through which the noise-suppressed exhaust gas is emitted. The engine 10 may be a V-engine with two banks 20 of cylinders aligned in a "V", as will be understood by those of ordinary skill in the art. Each bank 20 of the engine 10 may feed exhaust to a separate exhaust inlet pipe 16 leading to the muffler 14. However, in alternative arrangements, the engine 10 may be an inline engine with a single exhaust inlet pipe 16 leading to the muffler 14. In other alternative arrangements, the engine 10 may have more than two exhaust inlet pipes 16.

Figure 2:
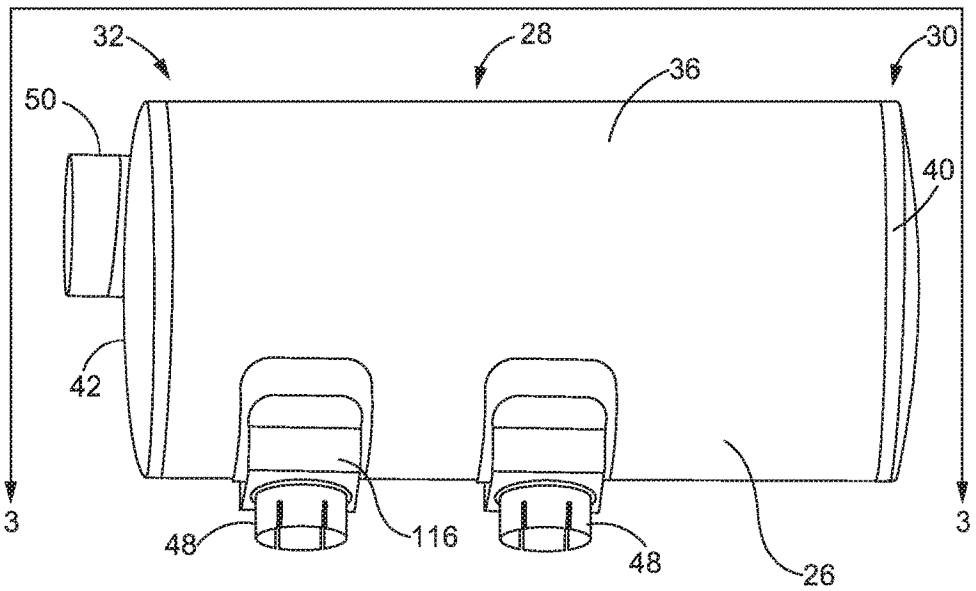
FIG. 2 is a side view of the muffler of FIG. 1 shown in isolation, constructed in accordance with the present disclosure.

Turning to FIGS. 2-3, the muffler 14 is shown in isolation. The muffler 14 may have an expansion chamber 22 through which the exhaust gases expand to reduce noise from combustion (see FIG. 3). The expansion chamber 22 may include a resonance chamber 24 that enhances the acoustic performance of the muffler 14, as will be understood by those with ordinary skill in the art. Surrounding the expansion chamber 22 may be an annular double shell housing 26 that includes a body portion 28 extending axially between a first end 30 and a second end 32 (see FIG. 2). The double shell housing 26 may be formed from an annular inner shell 34 that faces the expansion chamber 22, and an outer shell 36 surrounding the inner shell 34 (see FIG. 3). The inner shell 34 may be perforated, while the outer shell 36 may be non-perforated. As a non-limiting example, the inner shell 34 may be formed from stainless steel, and the outer shell 36 may be formed from aluminized steel, although other suitable metals, metal alloys, and materials may also be used. Interposed between the inner shell 34 and the outer shell 36 may be one or more layers of insulation 38 (e.g., glass fiber, etc.) that provide thermal insulation between the inner shell 34 and the outer shell 36. As the inner shell 34 may be exposed to high temperature exhaust flowing through the muffler 14, it may undergo thermal expansion and contraction. As the outer shell 36 is insulated from the inner shell 34, thermal gradients may develop between the inner shell 34 and the outer shell 36 when the inner shell 34 is exposed to high temperature exhaust.

Enclosing the muffler 14 on the first and second ends 30 and 32 of the housing 26 may be a first end cap 40 and a second end cap 42, respectively. As shown in FIG. 3, the first end cap 40 and the second end cap 42 may have inner surfaces 44 and 46, respectively, that face the expansion chamber 22 of the muffler. Furthermore, the muffler 14 may have one or more inlet tubes 48 extending through the inner shell 34 and the outer shell 36 of the body portion 28, as well as a partially perforated outlet tube 50 extending through the expansion chamber 22 and the second end cap 42 (see FIG. 3). The inlet tube(s) 48 may be in fluid communication with the exhaust inlet pipe(s) 16, while the outlet tube 50 may be in fluid communication with the exhaust outlet pipe 18. For example, if the engine 10 includes two exhaust inlet pipes 16, the muffler may have two inlet tubes 48 each in fluid communication with a respective one of the inlet pipes 16. In alternative designs, the placement of the outlet tube 50 and the inlet tube(s) 48 on the body of the muffler 14 may vary.

Referring to FIG. 3, the muffler 14 may further include additional optional components such as a first perforated baffle 52 disposed at the first end 30 between the expansion chamber 22 and the first end cap 40, and a second perforated baffle 54 disposed at the second end 32 between the expansion chamber 22 and the second end cap 42. In addition, insulation 56 (e.g., glass fiber) may be optionally placed between the first baffle 52 and the first end cap 40, with the first baffle 52 welded (or otherwise attached by another joining method such as brazing, soldering, adhesively bonding, mechanical bonding, etc.) to the inner shell 34 at a joint 58 and holding the insulation 56 in place (also see FIG. 4). Insulation 56 (e.g., glass fiber) may also be placed between the second baffle 54 and the second end cap 42, with the second baffle 54 holding the insulation 56 in place. Moreover, an optional baffle 60 may provide a vertical support for a portion of the outlet tube 50 that extends through the expansion chamber 22 (see FIG. 3). Alternative designs of the muffler 14 may lack one or more of these optional components.

Referring now to FIGS. 4-5, one or more C-brackets 62 may be used to separate the inner shell 34 and the outer shell 36 at each of the first and second ends 30 and 32 of the double shell housing 26. As the connections between the C-brackets 62 and the inner and outer shells 34 and 36 are substantially the same at both of the ends 30 and 32, only the connection at the first end 30 is shown in FIG. 4. The C-bracket 62 may include a first leg 64, a second leg 66 extending substantially parallel to the first leg 64, and a linking portion 68 that connects the first leg 64 to the second leg 66. In some arrangements, the second leg 66 may have a chamfered edge 70 to facilitate insertion of the C-bracket 62 between the inner and outer shells 34 and 36 (see FIG. 5). The C-bracket 62 may be formed from aluminized steel or other suitable metals, metal alloys, and materials.

The first leg 64 may be welded to the inner shell 34 at a joint 72, while the second leg 66 may be in abutting or sliding engagement to the outer shell 36 (see FIG. 4). In other arrangements, the first leg 64 may be joined or attached to the inner shell 34 by another joining method such as, but not limited to, brazing, soldering, adhesively bonding, mechanical bonding with fasteners, etc. The joint 72 between the C-bracket 62 and the inner shell 34 may be a continuous, unbroken weld between an edge 74 of the first leg 64 and an outer surface 76 of the inner shell 34. Without welded connections to the outer shell 36, the C-bracket 62 may allow the inner shell 34 to expand and contract thermally without subjecting the outer shell 36 to thermal stress. Accordingly, the C-bracket connection disclosed herein may reduce or eliminate cracking of the outer shell 36 caused by thermal expansion/contraction of the inner shell 34 as may occur in prior art systems in which the outer shell 36 and the inner shell 34 are both welded to an interconnecting bracket.

To prevent lateral (sideways) shifting of the inner shell 34, the linking portion 68 of the C-bracket 62 may be placed in abutting engagement with the inner surface 44 of the first end cap 40. A similar abutting engagement between the linking portion 68 of the C-bracket 62 and the inner surface 46 of the second end cap 42 may also be present at the second end 32 to reduce lateral shifting of the inner shell 34 (see FIG. 10).

Figure 6:
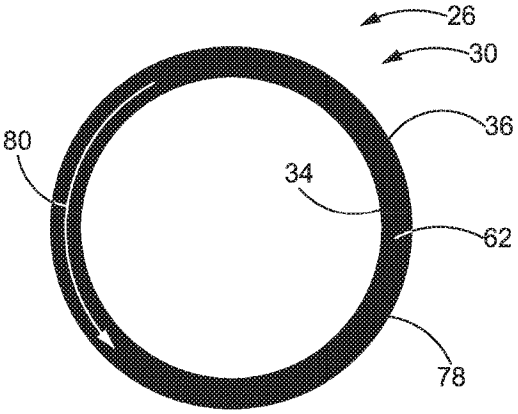
FIG. 6 is a side view a first end of the double shell housing with a first end cap and internal components removed, illustrating a continuous C-bracket ring between an inner shell and an outer shell of the double shell housing, constructed in accordance with the present disclosure.

One possible configuration of the C-bracket 62 at the first end 30 of the double shell housing 26 is shown in FIG. 6. As the configuration of the C-bracket 62 may be substantially the same at the second end 32, only the first end 30 is shown. The C-bracket 62 at each of the first and second ends 30 and 32 may form a single, continuous ring 78 that extends 360° around a circumferential axis 80 between the inner shell 34 and the outer shell 36. The continuous ring 78 may be a single part that extends around a periphery of the inner shell 34 while in physical contact with both the inner shell 34 and the outer shell 36. In this arrangement, the joint 72 between the first leg 64 and the inner shell 34 may be a continuous weld that extends 360° around the periphery of the inner shell 34.

Figure 7:
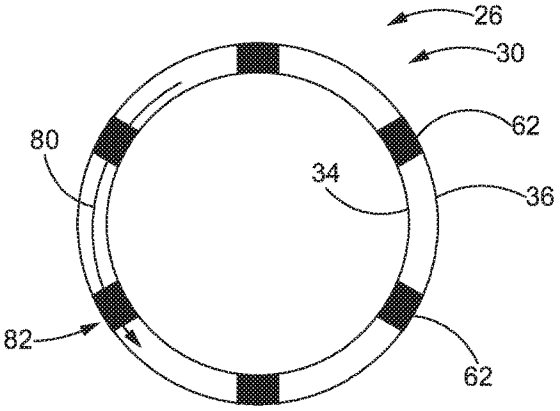
FIG. 7 is a side view similar to FIG. 6 but with a ring of multiple C-brackets between the inner shell and the outer shell, constructed in accordance with the present disclosure.

In an alternative arrangement shown in FIG. 7, a ring 82 of a plurality of separate C-brackets 62 may be spaced about the circumferential axis 80 between the inner and outer shells 34 and 36 at both ends 30 and 32 of the housing 26. In this arrangement, the plurality of the C-brackets 62 may be equally distributed around the circumferential axis 80. For instance, in one arrangement, the ring 82 may include six C-brackets 62 spaced 60° apart around the circumferential axis 80. However, it will be understood that the ring 82 may have more or less than six C-brackets 62 with different spacings therebetween. In other arrangements, the C-brackets 62 of the ring 82 may be unequally distributed around the circumferential axis 80.

Figure 8:
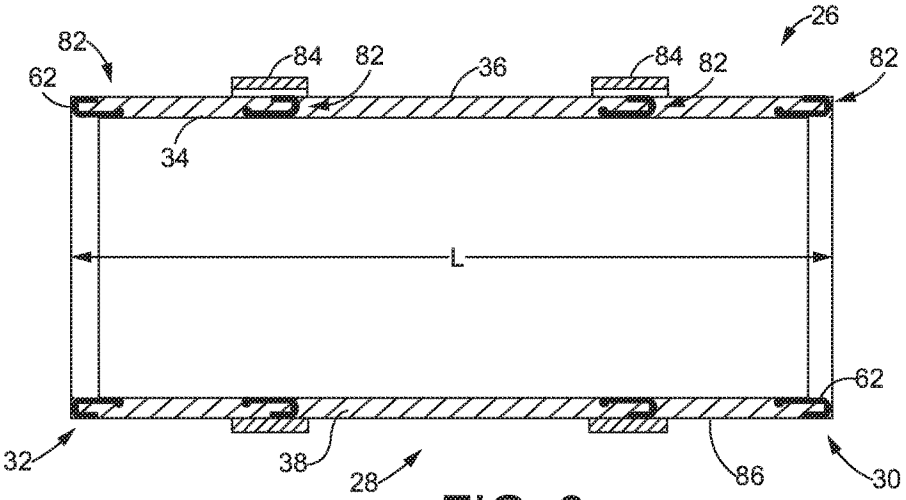
FIG. 8 is a cross-sectional view of the double shell housing of the muffler, illustrating multiple rings of C-brackets between the inner shell and the outer shell along a body portion of the double shell housing, constructed in accordance with the present disclosure.

The rings 82 of separate C-brackets 62 may be distributed along the axial length (L) of the body portion 28 of the double shell housing 26 with each of the rings 82 extending 360° around a circumferential axis between the inner and outer shells 34 and 36, as shown in FIG. 8. More specifically, the double shell housing 26 may have a ring 82 of C-brackets 62 at each of the first and second ends 30 and 32, as well as one or more rings 82 of C-brackets 62 that are distributed along the body portion 28 between the first and second ends 30 and 32. The rings 82 along the body portion 28 may contribute to the rigidity of the double shell housing 26. In addition, mounting straps 84 that mount the muffler 14 to the engine 10 may be wrapped around an outer surface 86 of the outer shell 36 above the rings 82 between the ends 30 and 32 to further enhance the rigidity of the double shell housing 26. In alternative arrangements, one or more of the C-brackets 62 along the body portion 28 or at the ends 30 and 32 may be continuous rings 78, as shown in FIG. 6.

Figure 9:
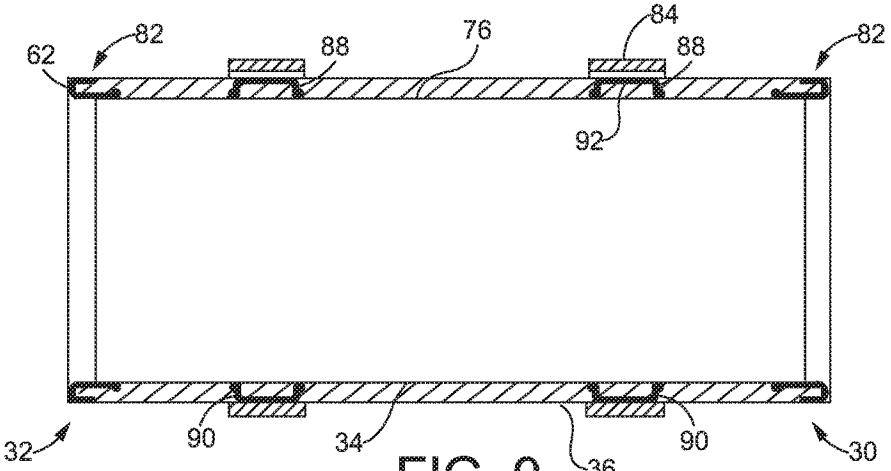
FIG. 9 is a cross-sectional view similar to FIG. 8, but with inverted U-ring brackets between the inner shell and the outer shell along a center of the body portion of the double shell housing, constructed in accordance with the present disclosure.

Alternatively, as shown in FIG. 9, the double shell housing 26 may have one or more inverted U-ring brackets 88 distributed along the length (L) of the body portion 28, with a ring 82 of C-brackets 62 at each of the ends 30 and 32. Each of the inverted U-ring brackets 88 may be a continuous ring that extends 360° around a circumferential axis between the inner and outer shells 34 and 36. Each of the inverted U-ring brackets 88 may have two legs 90 that are both welded (or otherwise attached by another joining method such as, but not limited to, brazing, soldering, adhesive or mechanical bonding, etc.) to the outer surface 76 of the inner shell 34, and a linking portion 92 between the two legs 90 that is in abutting or sliding engagement with the outer shell 36. The welds between the legs 90 and the inner shell 34 may extend 360° around the periphery of the inner shell 34. Without welded connections to the outer shell 36, the inverted U-ring brackets 88 and the C-brackets 62 may permit the inner shell 34 to expand and contract thermally without imposing thermal stress on the outer shell 36. In other arrangements, one or more of the C-brackets 62 or the inverted U-ring brackets 88 may be a continuous C-bracket ring 78, as shown in FIG. 6.

Figure 10:
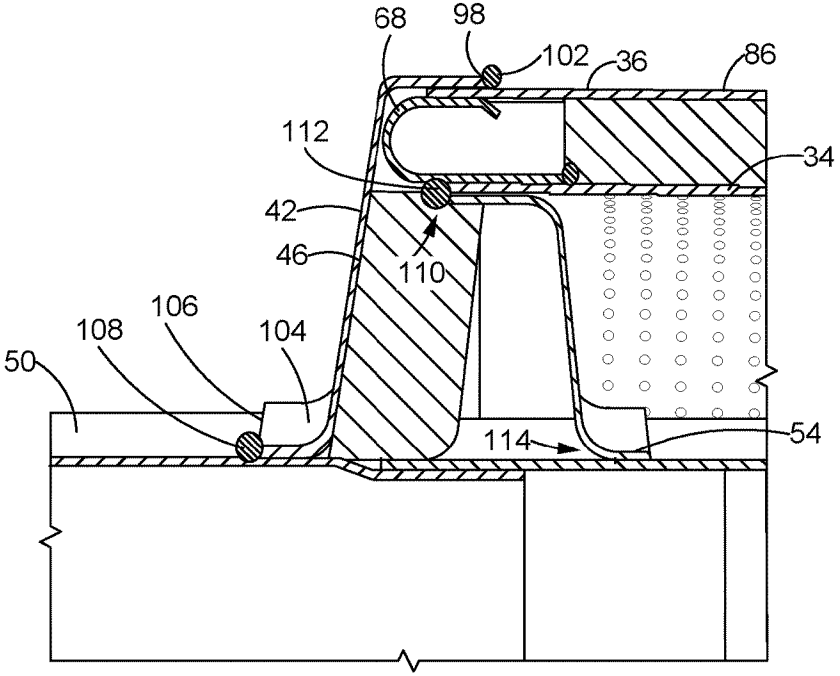
FIG. 10 is an expanded view of detail 10 of FIG. 3, constructed in accordance with the present disclosure.

Turning now to FIGS. 4 and 10, the welded connections between the first and second end caps 40 and 42 and the double shell housing 26 are shown. Referring to FIG. 4, the first end cap 40 may have an edge 94 that is welded (or otherwise attached by another joining method such as, but not limited to, brazing, soldering, adhesive or mechanical bonding, etc.) to the outer surface 86 of the outer shell 36 by a joint 96 (see FIG. 4). In addition, as shown in FIG. 10, the second end cap 42 may have a first edge 98 that is welded (or otherwise attached by another joining method such as, but not limited to, brazing, soldering, adhesive or mechanical bonding, etc.) to the outer surface 86 of the outer shell 36 by a joint 102. The joints 96 and 102 may be continuous, unbroken welds that extend 360° around the periphery of the outer shell 36. The second end cap 42 may also have a flanged opening 104 through which the outlet tube 50 is inserted, and the flanged opening 104 may have an edge 106 that is welded (or otherwise attached by another joining method such as, but not limited to, brazing, soldering, adhesive or mechanical bonding, etc.) to the outlet tube 50 by a joint 108 (see FIG. 10). The joint 108 may be a continuous, unbroken weld that extends 360° around a periphery of the outlet tube 50. As such, the outlet tube 50 and the second end cap 42 are not constrained to the inner shell 34 with welds. This may further provide the inner shell 34 with freedom to expand and contract thermally without subjecting the outlet tube 50 and the second end cap 42 to thermal stress and weld cracking.

Referring to FIG. 10, a first end 110 of the second baffle 54 may be welded (or otherwise attached by another joining method such as, but not limited to, brazing, soldering, adhesive or mechanical bonding, etc.) to the inner shell 34 by a joint 112 that extends 360° around the wall of the inner shell 34. A second end 114 of the baffle 54 may be slidingly engaged with the outlet tube 50 in a mechanical slip fit so as not to constrain both the inner shell 34 and the outlet tube 50 simultaneously with a welded connection. Accordingly, this connection avoids cracking at the outlet tube 50 caused by thermal expansion/contraction of the inner shell 34.

Figure 11:
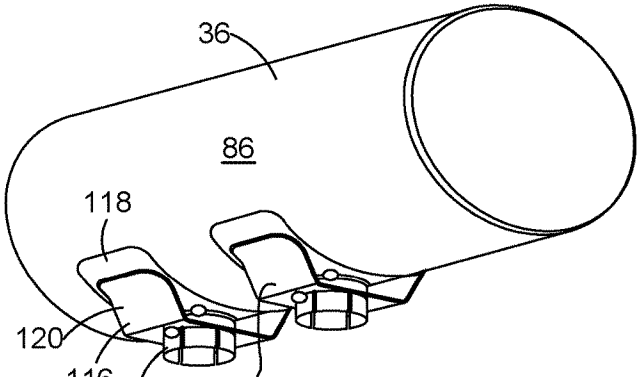
FIG. 11 is a perspective view of the muffler, illustrating support brackets that support inlet tubes on the muffler, constructed in accordance with the present disclosure.
Figure 12:
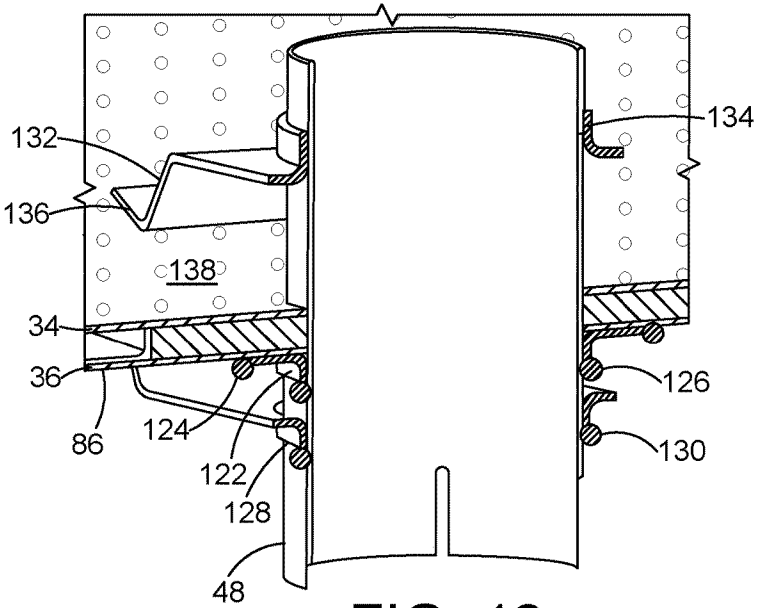
FIG. 12 is an expanded view of detail 12 of FIG. 3, constructed in accordance with the present disclosure.

Support brackets 116 for supporting the inlet tubes 48 on the outer shell 36 are shown in FIGS. 11-12. Each support bracket 116 may include a curved base plate 118 that contacts the outer surface 86 of the outer shell 36 and has a curvature that is complementary to the outer shell 36. Welded (or otherwise attached/joined) to the base plate 118 may be an inlet support bracket 120 that extends radially outward from the base plate 118. In alternative arrangements, the support bracket 116 may have alternative geometries to accommodate curved or angled inlet tubes 48.

The base plate 118 may have a flanged opening 122 through which the inlet tube 48 may be inserted (see FIG. 12). As shown in FIG. 12, the base plate 118 may be welded (or otherwise attached by another joining method such as, but not limited to, brazing, soldering, adhesive or mechanical bonding, etc.) to the outer surface 86 of the outer shell 36 with a joint 124, and the flanged opening 122 may be welded (or otherwise attached by another joining method such as, but not limited to, brazing, soldering, adhesive or mechanical bonding, etc.) to the inlet tube 48 with a joint 126. The joint 126 between the flanged opening 122 and the inlet tube 48 may be a continuous weld that extends 360° around a periphery of the inlet tube 48 to prevent leakage of exhaust gas. Furthermore, the inlet support bracket 120 may have a flanged opening 128 through which the inlet tube 48 may be inserted. The flanged opening 128 may be welded (or otherwise attached by another joining method such as, but not limited to, brazing, soldering, adhesive or mechanical bonding, etc.) to the inlet tube 48 with a skip weld joint 130 formed from discontinuous welds that are spaced apart around a periphery of the inlet tube 48. The use of skip welds minimizes exposure of the inlet tube 48 to high welding temperatures and reduces distortion of the inlet tube 48. Accordingly, the support bracket 116 supports the inlet tube 48 on the double shell housing 26 without welds to the inner shell 34. This reduces the possibility of weld cracking at the inlet tube 48 caused by thermal expansion and contraction of the inner shell 34.

Optionally, a bracket 132 may be used to anchor the inlet tube 48 on the inner shell 34, as shown in FIG. 12. The bracket 132 may have a flanged opening 134 that slidingly engages the inlet tube 48, and a mounting foot 136 that is welded (or otherwise attached by another joining method such as, but not limited to, brazing, soldering, adhesive or mechanical bonding, etc.) to an inner surface 138 of the inner shell 34. In alternative arrangements, the inlet tube 48 may not be anchored on the inner shell 34 with a bracket. In either case, the inlet tube 48 is not constrained to the inner shell 34 with a welded connection, thereby reducing cracking of welds at the inlet tube 48 caused by thermal expansion or contraction of the inner shell 34.

The joints disclosed herein may be fillet welds having a fillet radius of about three millimeters. However, depending on the dimensions and design of the muffler components, the fillet radius may vary.

INDUSTRIAL APPLICABILITY

In general, the teachings of the present disclosure may find applicability in many industries including, but not limited to, construction, mining, automotive, and agriculture industries. More specifically, the muffler design disclosed herein may be applicable to any industry utilizing mufflers with a double shell housing.

Figure 13:
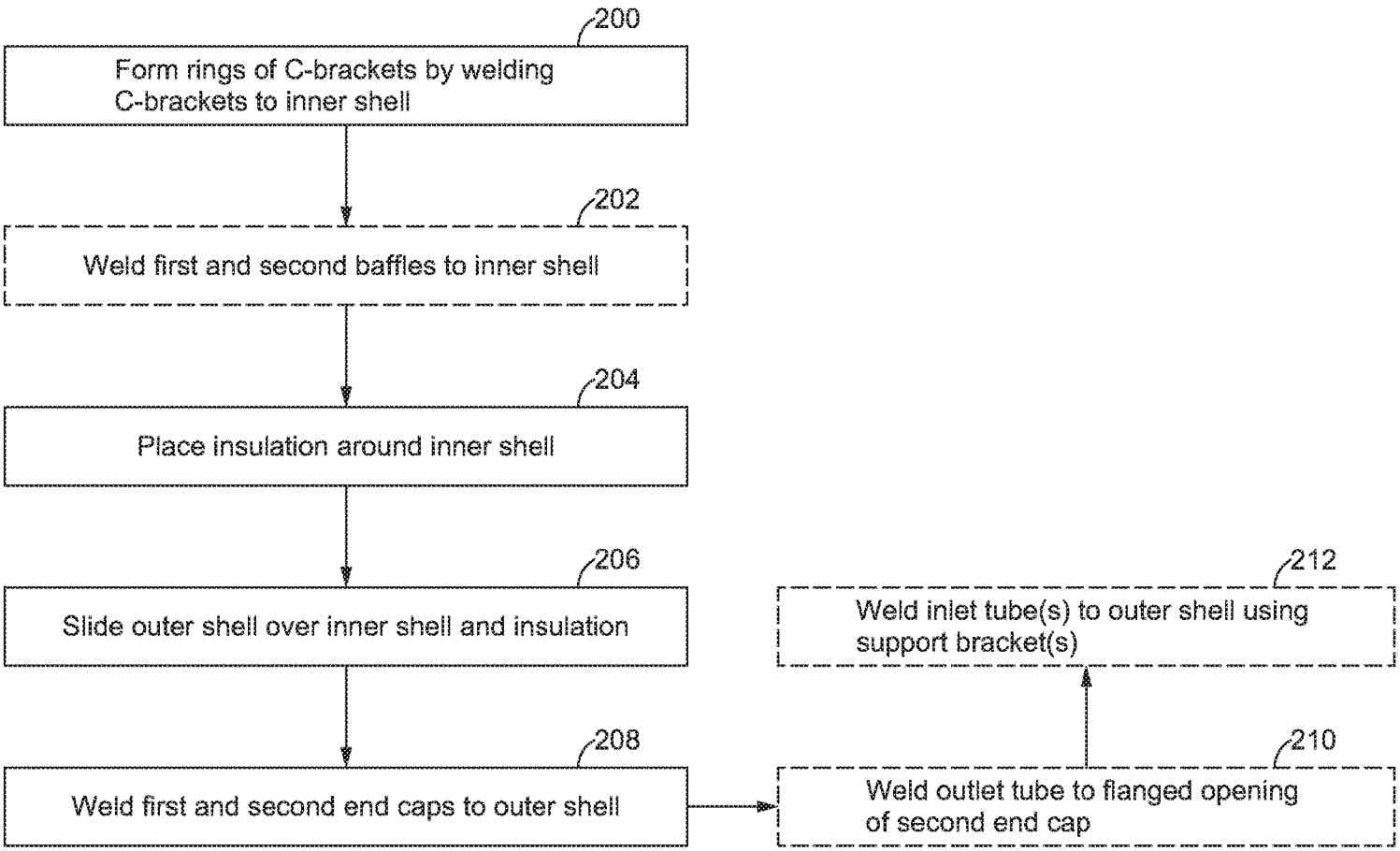
FIG. 13 is a flowchart depicting a series of steps that may be involved fabricating the muffler, constructed in accordance with a method of the present disclosure.

FIG. 13 shows a series of steps that may be involved in fabricating the muffler 14 having the double shell housing 26. Beginning with a first block 200, the rings 82 of C-brackets 62 may be formed by welding (or otherwise attaching by another joining method such as, but not limited to, brazing, soldering, adhesive or mechanical bonding, etc.) the first leg 64 of each of the C-brackets 62 to the outer surface 76 of the inner shell 34. The rings 82 may be placed at the first and second ends 30 and 32, and additional rings 82 of C-brackets 62 may be distributed along the length of the body portion 28 as shown in FIG. 8. In some cases, one or more of the rings of C-brackets may be continuous rings 78 of a single, annular C-bracket as shown in FIG. 6. Alternatively, the block 200 may involve welding (or otherwise attaching by another joining method such as, but not limited to, brazing, soldering, adhesive or mechanical bonding, etc.) the rings 82 of C-brackets 62 (or continuous rings 78 of C-brackets) at the first and second end 30 and 32, and welding the inverted U-ring brackets 88 along the body portion 28. Optionally, if the first and second baffles 52 and 54 are included in the muffler 14, the first and second baffles 52 and 54 may be welded to the inner shell 34 according to an optional block 202 (see FIGS. 4 and 10). The insulation 38 may then be placed around the inner shell 34 according to a next block 204. Optionally, the block 204 may also involve placing the insulation 56 on the sides of the inner shell 34 adjacent to the first and second baffles 52 and 54 (see FIG. 3).

Following placement of the insulation 38 around the inner shell 34, the outer shell 36 may be slid over the inner shell 34 and the insulation 38 to place the second legs 66 of the C-brackets 62 (or the linking portions 92 of the inverted U-ring brackets 88) in sliding engagement with the outer shell 36 (block 206). Alternatively, the C-brackets 62 at the first and second ends 30 and 32 may be inserted between the inner and outer shells 34 and 36 after the outer shell 36 is assembled with the inner shell 34. According to a next block 208, the first and second end caps 40 and 42 may be welded (or otherwise attached by another joining method such as, but not limited to, brazing, soldering, adhesive or mechanical bonding, etc.) to the outer surface 86 of the outer shell 36 at each of the ends 30 and 32 to place the inner surfaces 44 and 46 of the first and second end caps 40 and 42 in abutting engagement with the linking portions 68 of the C-brackets 62 (see FIGS. 4 and 10). The outlet tube 50 and the inlet tube(s) 48 may then be welded to the muffler 14 according to the optional blocks 210 and 212, respectively, with the blocks 210 and 212 being carried out in any order. Specifically, the block 210 may involve inserting the outlet tube 50 through the flanged opening 104 of the second end cap 42 and welding the flanged opening 104 to the outlet tube 50 (see FIG. 10). In addition, the block 212 may involve welding the base plate 118 of the support bracket 116 to the outer surface 86 of the outer shell 36 and inserting the inlet tube 48 through the flanged openings 122 and 128 of the support bracket 116. The flanged opening 122 of the base plate 118 may be welded to the inlet tube 48 with the continuous joint 126, while the flanged opening 128 of the inlet support bracket 120 may be welded to the inlet tube 48 with the skip joint 130 (see FIG. 12).

The use of C-brackets to separate the inner and outer shells of the muffler disclosed herein allows the inner shell to expand and contract thermally without subjecting the outer shell to thermal stress. Specifically, the C-brackets are welded to the inner shell only, and are in sliding engagement with the outer shell. As the inner shell and the outer shell are not simultaneously constrained to the C-brackets with welds, this arrangement reduces or eliminates weld cracking at the outer shell and early failure of the muffler as is seen in some prior art systems. Moreover, the C-brackets are in abutting engagement with the end caps of the muffler, which prevents lateral sliding of the inner shell within the muffler. The C-brackets are wide enough to distribute thermal and vibratory loads over a broad surface area, which further mitigates point contact defects of the double shell housing. Furthermore, the inlet tubes of the muffler disclosed herein are supported on the outer shell with support brackets and are not welded to the inner shell, which prevents weld cracking at the inlet tubes caused by thermal expansion and contraction of the inner shell.

It is expected that the technology disclosed herein may find wide industrial applicability in a wide range of areas such as, but not limited to, construction, automotive, marine, mining, agriculture, and earth-moving equipment applications.

What is claimed is:

1. A muffler for exhaust from an internal combustion engine, comprising:

an expansion chamber;

a double shell housing surrounding the expansion chamber and extending from a first end to a second end, the double shell housing including an annular perforated inner shell, an annular outer shell surrounding the inner shell, and an insulation between the inner shell and the outer shell;

a first end cap at the first end of the double shell housing, the first end cap having an inner surface facing the expansion chamber;

a second end cap at the second end of the double shell housing, the second end cap having an inner surface facing the expansion chamber; and at least one C-bracket between the inner shell and the outer shell at each of the first and second ends of the double shell housing, each of the C-brackets including a first leg, a second leg, and a linking portion connecting the first leg and the second leg, the second leg being in abutting engagement with the outer shell, the linking portion of the C-bracket at the first end being in abutting engagement with the inner surface of the first end cap, the linking portion of the C-bracket at the second end being in abutting engagement with the inner surface of the second end cap.

2. The muffler of claim 1, wherein the first leg is joined to the inner shell with by one of welding, brazing, soldering, adhesive bonding, and mechanical bonding.

3. The muffler of claim 1, wherein the first leg is welded to the inner shell.

4. The muffler of claim 1, wherein the C-brackets at the first end and the second end each form a single, continuous ring extending around a circumferential axis between the inner shell and the outer shell.

5. The muffler of claim 1, wherein the muffler further comprises a ring of C-brackets at each of the first end and the second end of the double shell housing, and wherein each of the rings includes a plurality of C-brackets equally distributed around a circumferential axis between the inner shell and the outer shell.

6. The muffler of claim 5, wherein each of the rings of C-brackets include six C-brackets spaced 60° apart around the circumferential axis.

7. The muffler of claim 5, wherein the second leg of each of the C-brackets includes a chamfered edge.

8. The muffler of claim 5, wherein the double shell housing further includes a body portion extending axially between the first end and the second end, wherein the muffler further includes a plurality of rings of C-brackets disposed between the inner shell and the outer shell that are distributed along a length of the body portion of the double shell housing.

9. The muffler of claim 5, wherein the first and second end caps are welded to an outer surface of the outer shell.

10. The muffler of claim 9, wherein the muffler further comprises at least one inlet tube extending through the inner shell and the outer shell of the double shell housing, and at least one support bracket supporting the inlet tube on the outer shell, the support bracket being welded to the outer shell and the inlet tube.

11. The muffler of claim 10, wherein the support bracket includes a base plate welded to the outer surface of the outer shell and an inlet support bracket spaced radially outward from the base plate, the base plate being welded to the inlet tube with a continuous joint, the inlet support bracket being welded to the inlet tube with a skip joint.

12. A muffler for exhaust from an internal combustion engine, comprising:

an expansion chamber;

a double shell housing surrounding the expansion chamber and having body portion extending axially between a first end and a second end, the body portion being formed from an annular perforated inner shell and an outer shell surrounding the inner shell;

an insulation between the inner shell and the outer shell;

a first end cap at the first end of the double shell housing, the first end cap having an inner surface facing the expansion chamber;

a second end cap at the second end of the double shell housing, the second end cap having an inner surface facing the expansion chamber; and a ring of C-brackets between the inner shell and the outer shell at each of the first and second ends of the double shell housing, each of the rings of C-brackets including a plurality of C-brackets distributed around a circumferential axis between the inner shell and the outer shell, each of the C-brackets including a first leg, a second leg, and a linking portion connecting the first leg and the second leg, the second legs of the C-brackets being in abutting engagement with the outer shell, the linking portions of the C-brackets at the first end being in abutting engagement with the inner surface of the first end cap, the linking portions of the C-brackets at the second end being in abutting engagement with the inner surface of the second end cap.

13. The muffler of claim 12, wherein the first legs of the C-brackets are welded to the inner shell.

14. The muffler of claim 13, further comprising a plurality of rings of C-brackets disposed between the inner shell and the outer shell that are distributed along a length of the body portion of the double shell housing, each of the rings of C-brackets along the body portion including a plurality of C-brackets spaced around a circumferential axis between the inner shell and the outer shell, each of the C-brackets in each ring including a first leg welded to the inner shell and a second leg in abutting engagement with the outer shell.

15. The muffler of claim 14, wherein the C-brackets in each of the rings are spaced 60° apart around the circumferential axis.

16. The muffler of claim 14, further comprising at least one inlet tube extending through the inner shell and the outer shell of the body portion of the double shell housing, the inlet tube being welded to an outer surface of the outer shell with a support bracket.

17. The muffler of claim 16, wherein the support bracket includes a base plate welded to the outer surface of the outer shell and an inlet support bracket spaced radially outward from the base plate, the base plate being welded to the inlet tube with a continuous joint, the inlet support bracket being welded to the inlet tube with a skip joint.

18. The muffler of claim 17, further comprising a first baffle between the expansion chamber and the first end cap and a second baffle between the expansion chamber and the second end cap, the first and second baffles being welded to the inner shell.

19. The muffler of claim 18, further comprising an outlet tube extending through the second end cap, the second baffle being in sliding engagement with the outlet tube.

20. A method of fabricating a muffler for exhaust from an internal combustion engine, the muffler including a double shell housing extending from a first end to a second end and being formed from an annular perforated inner shell and an annular outer shell surrounding the inner shell, the muffler further including a ring of C-brackets between the inner shell and the outer shell at each of the first and second ends of the double shell housing, each of the C-brackets including a first leg, a second leg, and a linking portion connecting the first leg and the second leg, the method comprising:

forming the ring of C-brackets around each of the first and second ends by welding the first leg of each of the C-brackets to an outer surface of the inner shell;

placing at least one layer of insulation around the outer surface of the inner shell;

sliding the outer shell around the inner shell and the layer of insulation so that the second leg of each of the C-brackets is in abutting engagement with the outer shell;

welding a first end cap to the outer shell at the first end so that an inner surface of the first end cap is in abutting engagement with the linking portions of the C-brackets at the first end; and welding a second end cap to the outer shell at the second end so that an inner surface of the second end cap is in abutting engagement with the linking portions of the C-brackets at the second end.

* * * * *